US006229498B1

(12) United States Patent
Matsuyoshi et al.

(10) Patent No.: US 6,229,498 B1
(45) Date of Patent: May 8, 2001

(54) HELICAL ANTENNA

(75) Inventors: Toshimitsu Matsuyoshi; Koichi Ogawa, both of Osaka; Kenichi Takahashi, Kanagawa, all of (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/415,207

(22) Filed: Oct. 12, 1999

(30) Foreign Application Priority Data

Oct. 9, 1998 (JP) ..... 10-287697
Sep. 29, 1999 (JP) ..... 11-275666

(51) Int. Cl.[7] ..... H01Q 1/36
(52) U.S. Cl. ..... 343/895; 343/850
(58) Field of Search ..... 343/895, 850, 343/702

(56) References Cited

U.S. PATENT DOCUMENTS 4,008,479 * 2/1977 Smith ..... 343/895
5,191,352 * 3/1993 Branson ..... 343/895
5,986,619 * 11/1999 Grybes et al. ..... 343/895

* cited by examiner

*Primary Examiner*—Don Wong
*Assistant Examiner*—James Clinger
(74) *Attorney, Agent, or Firm*—Jacobson, Price, Holman & Stern, PLLC

(57) ABSTRACT

Signal input units 105*a* to 108*a* of antenna elements 105 to 108 are held on the essentially same circumference. Signal output units 113*b*, 113*c*, 114*b*, and 114*c* of a feeding circuit 102 are held on a line which is located perpendicular to a plane where the above-described circumference is located, and also which passes through an essential center of this circumference. The feeding circuit 102 supplies feeding signals to the antenna elements 105 to 108 while applying predetermined phase differences to these feeding signals. As a result, electric lengths of feeding lines 119A to 119D are made coincident with each other. These feeding lines are to connect the signal output units 113*b*, 113*c*, 114*c* to the signal input units 105*a* to 108*a*.

16 Claims, 9 Drawing Sheets

HELICAL ANTENNA

BACKGROUND OF THE INVENTION

1. Field of the Invention

The present invention is related to a helical antenna used in a mobile wireless (radio) appliance such as a portable telephone.

2. Description of the Related Art

Very recently, mobile communications, e.g., portable telephones are rapidly developed. Not only ground mobile communication systems are available, but also satellite mobile communication systems are expected for practical uses. In such mobile communication terminals, antennas may constitute one of the major important devices, or components.

Now, one example of conventional 4-winding helical antennas will be described with reference to drawings. FIG. 11 schematically shows an electric power feeding circuit for this conventional helical antenna, and FIG. 12 is a plan view of the helical antenna to which electric power is supplied by employing the feeding circuit.

An (electric power) feeding circuit 200 is provided with a 3dB-hybrid circuit 201, a balun circuit 202, and another balun circuit 203. These circuits 201 to 203 are mounted, or packaged on the same plane of a mounting board 204 under such a condition that these circuits 201 to 203 are connected via a strip line having a resistance value of 50 Ω to each other.

The hybrid circuit 201 is a circuit for producing an output signal whose output phase is in phase with the input phase thereof (will be defined as a "0° output" hereinafter), and another output signal whose output phase is delayed by 90° from the input phase thereof (will be defined as a "90° output" hereinafter) from a signal which is supplied to the antenna for feeding the electric power. It should be noted that an output signal whose output phase is delayed by 180° from the input phase thereof is defined as a "180° output", and an output signal whose output phase is delayed by 270° from the input phase thereof is defined as a "270° output".

The balun circuit 202 contains a signal output unit 205 and another signal output unit 206. The 0° output derived from the hybrid circuit 201 is entered into the signal output circuit 205 and the signal output circuit 206, respectively. The signal output units 205 and 206 produce both the 0° output and the 180° output with respect to this input signal of the 0° output as feeding signals, and then output these feeding signals.

The balun circuit 203 contains a signal output unit 207 and another signal output unit 208. The 90° output derived from the hybrid circuit 201 is entered into the signal output circuit 207 and the signal output circuit 208, respectively. The signal output units 207 and 208 produce both the 0° output and the 180° output with respect to this input signal of the 90° output as feeding signals, and then output these feeding signals.

As a consequence, the relationship among these feeding signals is established as follows: That is, with respect to the 0° output of the signal output unit 205, the 180° output derived from the signal output unit 206 is delayed by 180°; the 0° output derived from the signal output unit 207 is delayed by 90°; and the 180° output derived from the signal output unit 208 is delayed by 270°.

In a helical antenna 210, 4 pieces of antenna elements (not shown) are arranged in a helical form along an outer surface of a hollow cylindrical body 211.

Each of the antenna elements owns each of signal input units 212 to 215. The respective signal input units 212 to 215 are arranged in an equi-interval of 90 degrees on an edge portion of the cylindrical body 211, and also are connected to the respective signal output units 205 to 208 via a power feeding line 216 made of a conductive line with maintaining an individual relationship among them.

As a result, the power feeding signals are supplied from the feeding circuit 200 to the respective antenna elements under such a condition that the phase differences among these feeding signals are made by 90 degrees.

On the other hand, the signal input units 212 to 215 of the respective antenna elements are arranged on an edge surface of the cylindrical body 211, namely on a circumference within the same plane.

However, the respective signal output units 205 to 208 of the feeding circuit 200 are arranged on the same straight line at an edge portion on the mounting plane of the board 204.

As a result, the connection distances "a" to "d" between the signal output units 205 to 208 and the signal input units 212 to 215 are made incoincident with each other.

In the case of the antenna arrangement shown in FIG. 12, the connection relationship is given by $d>a\cong b>c$. In particular, a distance difference between a connection distance "c" (interval between 207 and 213) and another connection distance "d" (interval between 208 and 215) becomes large.

As previously explained, while the connection distances "a" to "d" are made incoincident with each other, if the signal output units 205 to 208 are connected to the signal input units 212 to 215 by way of the feeding lines 216(*a*) to 216(*d*), then a large difference is produced in the lengths (electric lengths) of the feeding lines 216(*a*) to 216(*d*).

As a consequence, the feeding signals having the phase differences by 90 degrees are not originally supplied to the respective antenna elements. Accordingly, the axial ratio of the radiated circularly-polarized wave is increased. Furthermore, the horizontal plane directivity of this helical antenna is deteriorated. As a result, the signal transmission/reception cannot be carried out in high precision.

SUMMARY OF THE INVENTION

Accordingly, a major object of the present invention is to provide a helical antenna capable of transmitting/receiving a signal in high precision, while increasing precision in a phase difference of electric power feeding to the respective antenna elements.

Other objects, features, and advantages of the present invention may become apparent from the below-mentioned descriptions.

To achieve the above-described objects of the present invention, a helical antenna according to an aspect of the present invention, is featured by comprising: a plurality of antenna elements, each of which antenna elements having a signal input unit for an electric power feeding signal; feeding means having at least plural signal output units corresponding to the number of the signal input units, for outputting the feeding signals from the respective signal output units while giving a predetermined phase difference to the feeding signals; a first holding mechanism for holding the respective signal input units of the antenna elements on the substantially same circumference; a second holding mechanism for holding the respective signal output units of the feeding means on a line which is located perpendicular to a plane where the circumference is positioned, and also which passes through an essential center of the circumference; and a plurality of feeding lines for connecting the respective signal input units of the respective antenna elements to the respective signal output units of the feeding means with maintaining the individual relationship among them.

In the helical antenna, in view of the geometrical aspect, separation distances between one point on the line which passes through the essential center of the above-explained circumference and the arranging positions of the respective signal input units will become constant. As a consequence, in accordance with the present invention, since the signal output units are held on the above-explained line, the lengths of the respective feeding lines can be made substantially equal to each other. Namely, the separation intervals between the signal output units and the signal input units corresponding thereto can be made substantially coincident with each other.

BRIEF DESCRIPTION OF THE DRAWINGS

The remaining object of the invention will become apparent from the understanding of embodiment to be described hereinafter and will be clarified in the appended claims of the invention. A number of advantages, not touched upon herein, will be noticed by those skilled in the art, if the invention is practiced.

DETAILED DESCRIPTION OF THE INVENTION

Figure 1:
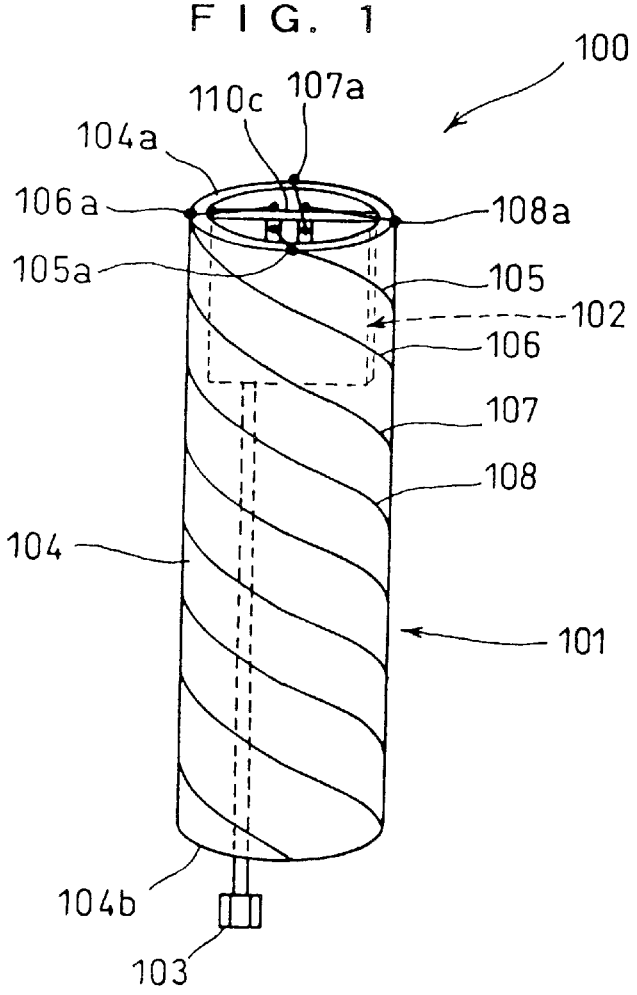
FIG. 1 is a perspective view for representing an outer view of the 4-winding helical antenna according to a first preferred embodiment of the present invention.

Referring now to drawings, various preferred embodiments of the present invention will be described in detail.

Referring to FIG. 1 to FIG. 5, reference numeral 100 shows a 4-winding helical antenna according to a first preferred embodiment of the present invention.

This helical antenna 100 is provided with an antenna main body 101, a (electric power) feeding circuit 102, and a (electric power) feeding connector 103.

The antenna main body 101 is equipped with a hollow cylindrical body 104 made of resin such as tetrafluoroethylene.

4 pieces of antenna elements 105 to 108 are provided on an outer peripheral surface of this cylindrical body 104. The antenna elements 105 to 108 are made of a conductive line mainly containing copper as a main material.

The respective antenna elements 105 to 108 are provided on the outer peripheral surface of the cylindrical body 104 in a helical shape with an equi-pitch and also an equi-interval.

Each of these antenna elements 105 to 108 has signal input portions 105*a* to 108*a* into which feeding signals are inputted, respectively. Each of these signal input portions 105*a* to 108*a* is provided on either an edge surface of the cylindrical body 104 or a place in the vicinity of this cylindrical body 104, otherwise, preferably on one edge 104*a* of this cylindrical body 104.

The respective signal input portions 105*a* to 108*a* are arranged in an equi-interval of 90 degrees along one edge 104*a*. Since such an arrangement is employed, the respective signal input portions 105*a* to 108*a* are held on the substantially same circumference within the substantially same plane. This cylindrical body 104 will constitute a first holding mechanism for holding the signal input portions 105*a* to 108*a*.

All of the antenna elements 105 to 108 are short circuited at the other edge 104*b* of the cylindrical body 104.

The feeding circuit 102 is mounted on a circuit board manufactured by stacking a plurality of boards, namely a stacked layer board 110. The stacked layer board 110 is held within the cylindrical body 104 in such a manner that an edge portion of this stacked layer board 110 is located within a plane which passes through the edge 104*a* of the cylindrical body 104.

The stacked layer board 110 is constructed in such a manner that a ground layer 111 is interposed between one pair of dielectric boards 110A and 110B such as a glass epoxy board.

A width "H" of the stacked layer board 110 is made slightly smaller than an inner diameter of the cylindrical body 104 in such a manner that the stacked layer boards 110 are stored into the cylindrical body 104 under stable state without any space along the radial direction. Both a 3-dB hybrid circuit 112 and a balun circuit 113 are mounted on one surface 110*a* of the stacked layer board 110. This one surface 110*a* is located on the outside of the dielectric board 110A.

The balun circuit 114 is mounted on the other surface 110*b* of the stacked layer board 110, and the other surface 110*b* is located on the outside of the dielectric board 10B.

The balun circuits 113 and 114 are arranged with sandwiching the stacked layer board 110 in such a manner that the balun circuit 113 is located opposite to the balun circuit 114 along the thickness direction thereof.

The hybrid circuit 112 contains a signal input unit 112*a* connected to the feeding connector 103, another signal output unit 112*b* for outputting a 0° output of this hybrid circuit 112, and also a further signal output unit 112*c* for outputting a 90° output thereof.

The balun circuit 113 enters thereinto the 0° output supplied from the signal output unit 112*b* of the hybrid circuit 112, and produces a 0° output and a 180° output as a feeding signal to output these 0° output and 180° output. This 0° output will be referred to as a "0° feeding output", as viewed from the feeding circuit 102, whereas the 180° output will be referred to as a "180° feeding output ", as viewed from the feeding circuit 102 with respect to this inputted 0° output.

The balun circuit 114 enters thereinto the 90° output supplied from the signal output unit 112*c* of the hybrid circuit 112, and produces a 0° output and a 180° output as a feeding signal to output these 0° output and 180° output. This 0° output will be referred to as a "90° feeding output", as viewed from the feeding circuit 102, whereas the 180° output will be referred to as a "270° feeding output", as viewed from the feeding circuit 102 with respect to this inputted 90° output.

It should be noted that the signal output unit 112*b* of the hybrid circuit 112 is connected to an unbalance terminal 113*a* of the balun circuit 113 via a signal line 115 having a resistance value of 50 Ω formed on the plane 110*a* of the stacked layer board 110.

The signal output unit 112*c* of the hybrid circuit 112 is connected to the unbalance terminal 114*a* of the balun circuit 114 via another 50 Ω-signal line 116 formed on the plane 110*a* of the stacked layer board 110, a throughhole electrode 117 formed on the board 110 by penetrating this board 110, and another 50 Ω-signal line 118 formed on the plane 110*b* of the board 110.

A notch 111*a* is formed in the ground layer 111. This notch 111*a* allows the throughhole electrode 117 to penetrate this notch 11*a* under electrically insulating condition.

The balun circuit 113 owns a signal output unit 113*b* for the 0° feeding output, and another signal output unit 113*c* for the 180° feeding output. This signal output unit 113*c* is extended up to a board edge 110*c* on one plane 110*a* of the board 110. This board edge 110*c* is located in the vicinity of the balun circuits 113 and 114.

The balun circuit 114 owns a signal output unit 114*b* for the 90° feeding output, and another signal output unit 114*c* for the 270° feeding output. This signal output unit 114*c* is extended up to the board edge portion 110*c* on the other plane 110*b* of the board 110.

Both the signal output units 113*b* and 113*c* of the balun circuit 113 are extended up to the edge portion 110*c* of the stacked layer board 110 by way of the 50 Ω-signal line. These signal output units 113*b* and 113*c* are arranged in the vicinity of a central portion of the plane 110*a* of the board 110 along the width "H" direction on this plane 110*a*. Furthermore, these signal output units 113*b* and 113*c* are arranged close to each other as being permitted as possible along the plane direction to such a degree that these signal output units 113*b* and 113*c* do not cause an electrical problem by each other.

Both the signal output units 114*b* and 114*c* of the balun circuit 114 are arranged in the vicinity of a central portion of the other plane 110*b* of the board 110 along the width "H" direction on this plane 110*b*. Furthermore, these signal output units 114*b* and 114*c* are arranged close to each other as being permitted as possible along the plane direction to such a degree that these signal output units 114*b* and 114*c* do not cause an electrical problem by each other.

In other words, each of these signal output units 113*b* to 114*c* is penetrated through an essential center on the same circumference on the edge 104*a* of the cylindrical body 104, namely within a plane, and then is held on a line perpendicular to this plane.

In this case, the stacked layer board 110 will constitute a second holding mechanism for holding these signal output units 114*b* and 114*c*.

The board edge portion 110*c* formed on one plane 110*a* of the board 110 will constitute a first arranging portion on which the signal output units 113*b* and 113*c* are arranged. The board edge portion 110*c* formed on the other plane 110*b* of the board 110 will constitute a second arranging portion on which the signal output units 114*b* and 114*c* are arranged. Then, an arranging portion is constituted by these first arranging portion and second arranging portion.

Both the hybrid circuit 112 and the balun circuit 113 formed on one plane will constitute a first phase adjusting circuit. The balun circuit 114 will constitute a second phase adjusting circuit.

The feeding circuit 102 equipped with the above-described arrangement is inserted into an internal space of the cylindrical body 104 to be arranged therein, while satisfying the below-mentioned conditions:

(1) A condition under which the edge 110*c* of the stacked layer board 110 is located on the side of the edge 104*a* of the cylindrical body 104.

(2) A condition under which the edge 110*c* of the stacked layer board 110 is positioned substantially coincident with the edge 104*a* of the cylindrical body 104.

Figure 2:
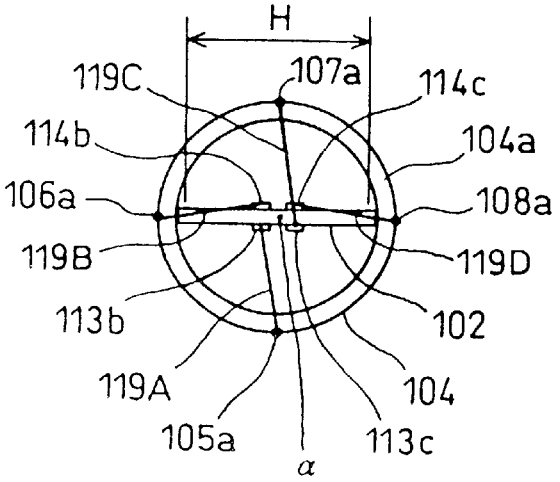
FIG. 2 is a plan view for showing the helical antenna of FIG. 1.
Figure 3:
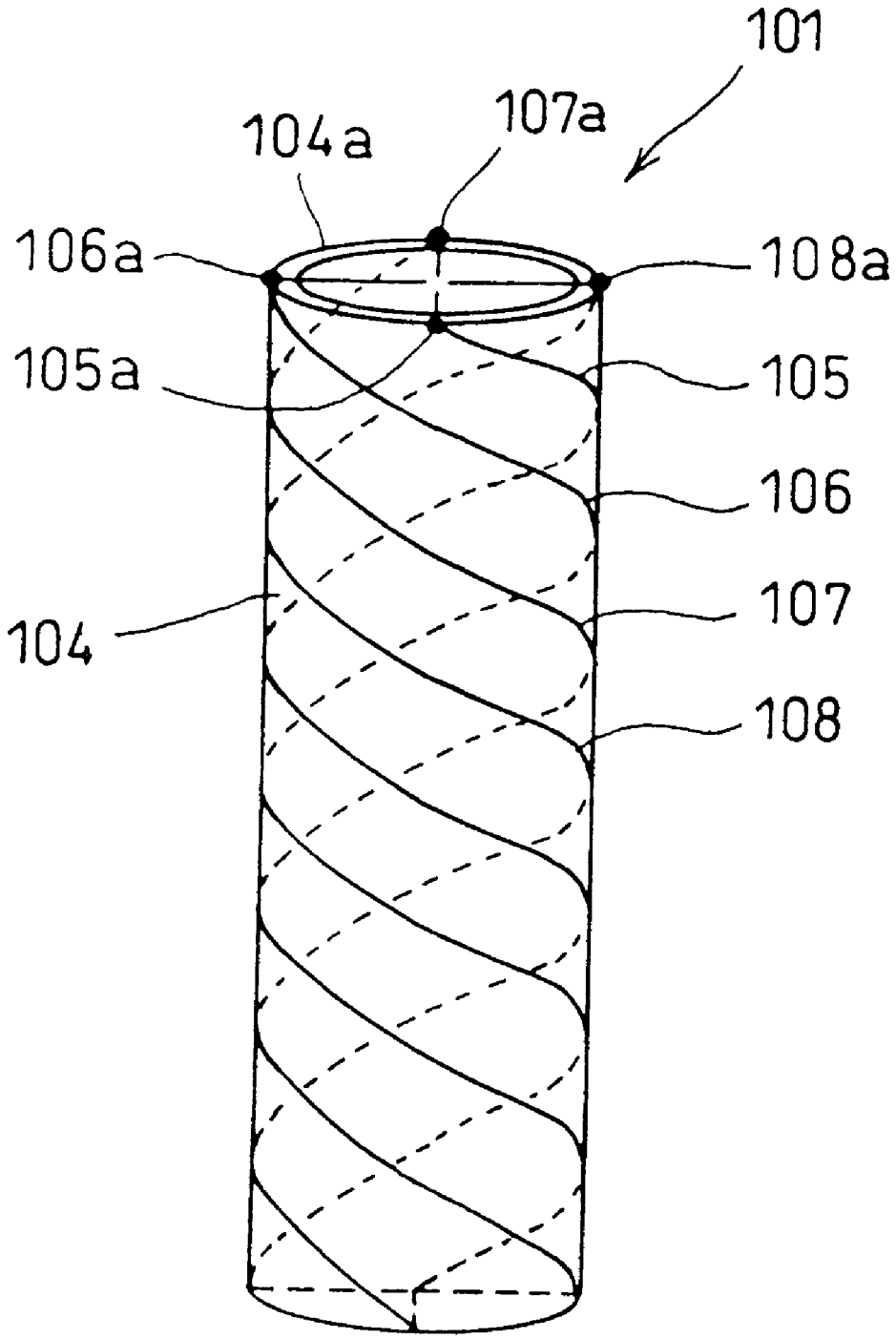
FIG. 3 is a perspective view for representing an outer view of a main body of the helical antenna shown in FIG. 1.
Figure 4:
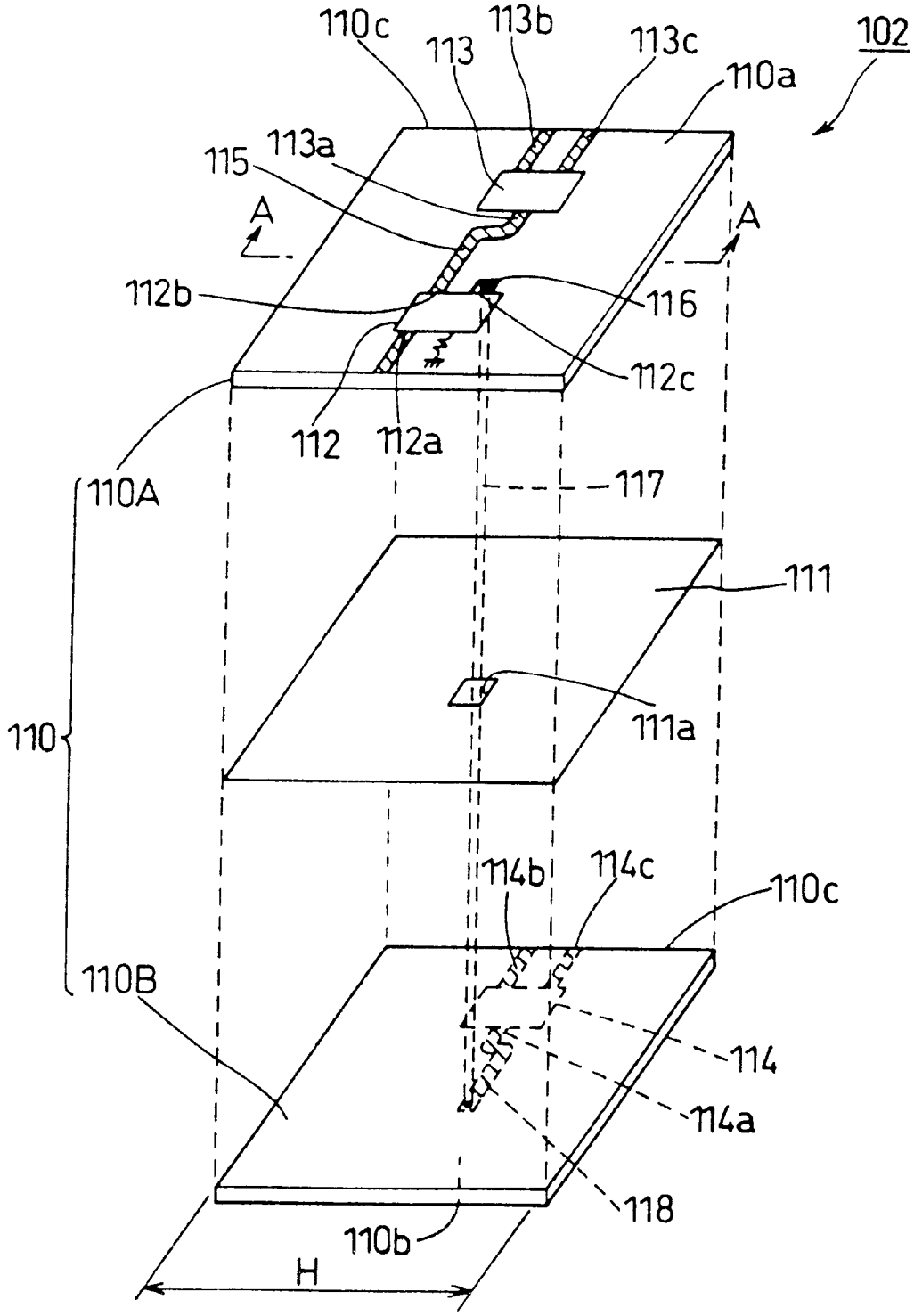
FIG. 4 is a fragmentary perspective view for indicating a feeding circuit of the helical antenna shown in FIG. 1.
Figure 5:
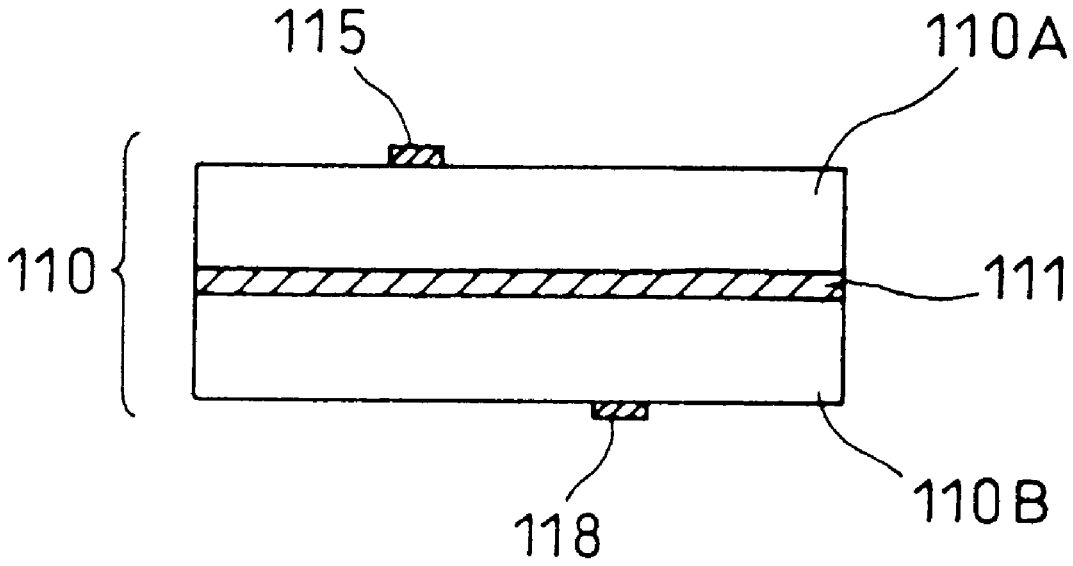
FIG. 5 is a sectional view of the helical antenna, taken along a line A—A of FIG. 4.
Figure 6:
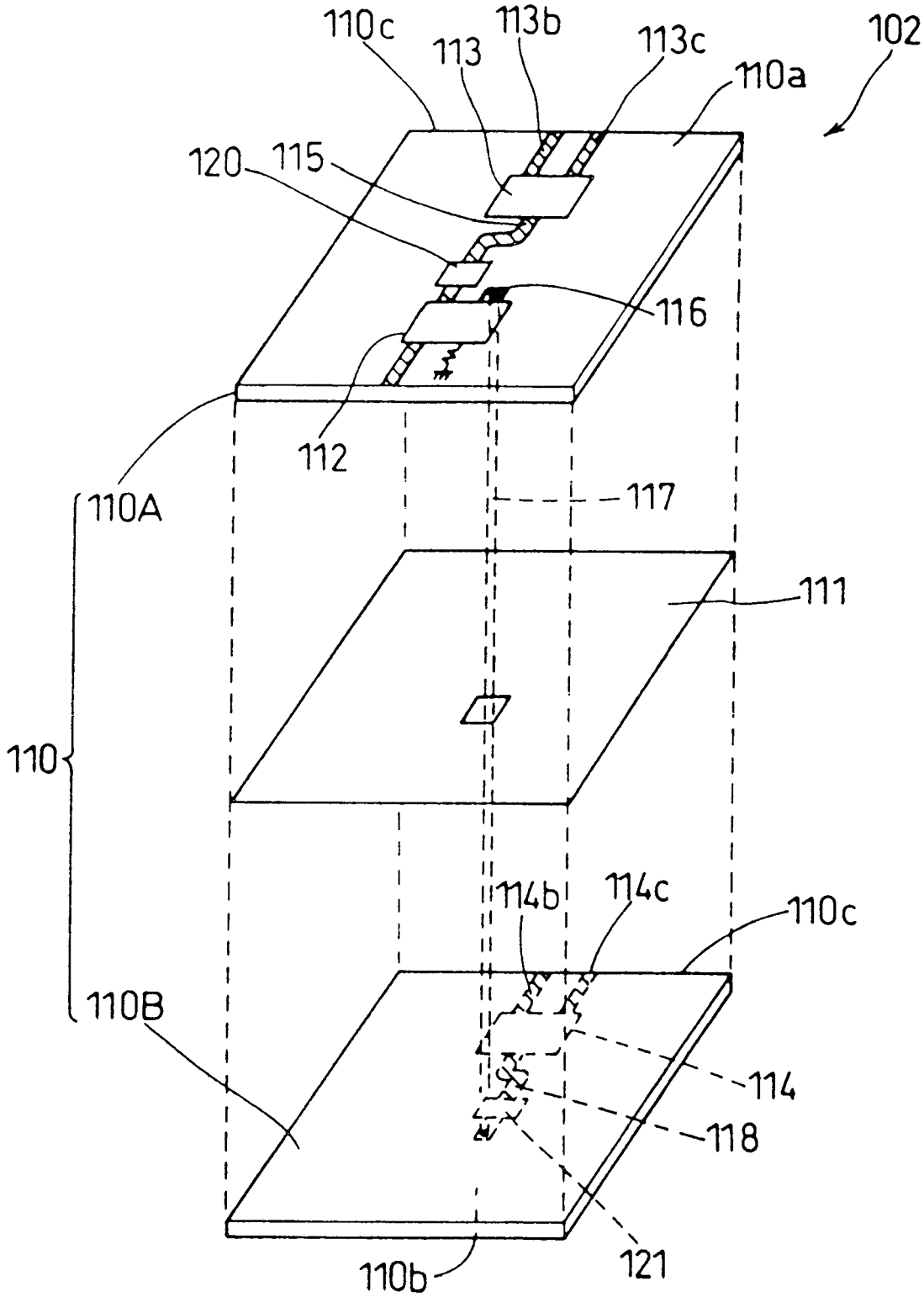
FIG. 6 is a fragmentary perspective view for representing a feeding circuit of an antenna element as one modification of FIG. 1.

(3) A condition that the direction of the width "H" of the stacked layer board 110 is made coincident with the opposite direction of either the combination between the signal input units 105*a* and 107*a* or the combination between the signal input units 106*a* and 108*a*, which are intersected with each other at a right angle (it should be noted that in FIG. 1 and FIG. 2, opposite direction of signal input portions 106*a* and 108*a* is made coincident with direction of width "H" of stacked layer board 110).

As previously explained, in this case, as to the feeding circuit 102, the width "H" of the board 110 is set to be slightly smaller than the inner diameter of the cylindrical body 104, and furthermore, the arranging position between the signal output units 113*b*/113*c* of the balun circuit 113 and the signal output units 114*b*/114*c* of the balun circuit 114 is set to the central portion of the board 110 along the width "H" direction.

As a result, the feeding circuit 102 stored in the cylindrical body 104 is arranged without any space along the radial direction of the cylindrical body 104. All of the signal output units 113*b* to 114*c* are arranged at positions which are made substantially coincident with an axial center "α" of the cylindrical body 104. This axial center "α" corresponds to the helical axes of the antenna elements 105 to 108.

As a consequence, all of the signal output units 113*b* to 114*c* may pass through the essential center of the above-explained circumference along which all of the corresponding signal input units 105*a* to 108*a* are arranged.

After the feeding circuit 102 has been stored into the cylindrical body 104, the respective signal output units 113*b* to 114*c* and also the respective signal input units 105*a* to 108*a* are connected to feeding lines 119A to 119D corresponding thereto.

As the first holding mechanism, the present invention is not limited to such a cylindrical body 104, the section of which is a circle, but other shaped cylinder bodies may be employed, the sections of which are selected from an elliptical shape, a polygonal shape, and so on. Also, the first holding mechanism may be realized by such a cylinder body having different diameters along an axial direction thereof, other than another cylinder body having a uniformly equal diameter along the axial direction.

When the respective signal output units 113*b* to 114*c* are connected to the respective signal input units 105*a* to 108*a* in the above-described manner, the electric lengths of the respective feeding lines 119A to 119D are made substantially equal to each other. In other words, the separation distances between the respective signal input units 105*a* to 108*a* formed on the edge 104*a*, and one point of the axial center "α" of the cylindrical body 104 may be made constant in view of the geometrical aspect. One point of this axial center "α" corresponds to one point on a vertical line of the arranging place of this circle, which passes through the essential center of the circumference along which the signal input units 105*a* to 108*a* are arranged.

As previously explained, the positions of the respective signal output units 113*b* to 114*c* are made substantially coincident with the axial center "α" of the cylindrical body 104. That is to say, the respective signal output units 113*b* to 114*b* are arranged close to one point on the axial center "α" of the cylindrical body 104 (namely, axial center "α" located on edge 104*a*) as being permitted as possible. As a consequence, the lengths of the respective feeding lines 119A to 119D are made substantially identical to each other, and these feeding lines 119A to 119D are used to connect the signal input units 105*a* to 108*a* with the respective signal output units 113*b* to 114*c*.

Moreover, since the positions of the respective signal output units 113*b* to 114*c* on the axial center "α" are made substantially identical to the positions of the respective signal input units 105*a* to 108*a* on the axial center "α", the electric lengths of the respective feeding lines 119A to 119D are made minimum, so that a better electric characteristic (resistance characteristic and so on) of the helical antenna can be achieved.

When signal transmission/reception are carried out by using the helical antenna 100 equipped with the above-described antenna structure, this helical antenna 100 may represent such a directivity characteristic having a conical beam characteristic with respect to the vertical plane. At this time, since the electrical lengths of the feeding lines 119A to 119D are substantially identical to each other, the power feeding phases to the respective elements 105 to 108 become correctly 90° different from each other. As a result, the circularly-polarized wave having the small axial ratio (nearly 0 dB) to the main radiation direction is irradiated with having the omnidirectional characteristic along the horizontal direction, and thus, the radiation characteristic is not deteriorated. For instance, as this deterioration of the radiation characteristic, the axial ratio of the radiated circularly-polarized wave is increased, and the horizontal plane directivity characteristic is deteriorated. In other words, in accordance with this helical antenna 100, the stable circularly-polarized wave can be radiated over the wide angle.

In this first preferred embodiment, the signal output unit 112*c* of the hybrid circuit 112 is connected to the signal output unit 114*a* of the balun circuit 114 via the throughhole electrode 117, the 50 Ω-signal line 116, and the 50 Ω-signal line 118, which are formed on the board 110. Alternatively, this connection may be carried out by employing not the above-described throughhole electrode, but other structures such as a jumper line. When such a modified structure is employed, no longer the notch 111*a* is formed in the ground layer 111, resulting in one-plane ground. This "one-plane ground" can be readily manufactured, so that the manufacturing steps for the board 110 may become easy.

Also, a helical-shaped groove capable of storing thereinto the antenna elements may be formed in an outer peripheral surface of the cylindrical body 104, and the respective antenna elements 105 to 108 may be stored in this helical-shaped groove. As a result, the shapes of the antenna elements 105 to 108 may be made in high precision, and furthermore, these antenna elements 105 to 108 may be readily stored/arranged. Accordingly, the electric characteristic of the 4-winding helical antenna may be stabilized, and moreover, this 4-winding helical antenna may be manufactured in a simple manner.

Although the feeding circuit 102 is inserted into the cylindrical body 104 so as to be arranged therein in this preferred embodiment, this feeding circuit 102 may be alternatively arranged in such a manner that this feeding circuit 102 is not inserted/arranged within the cylindrical body 104. In this alternative case, a similar effect may be achieved even when the following structure is employed. That is, for example, while the feeding circuit 102 is arranged at a lower portion of the cylindrical body 104, a feeding point is arranged at the lower portion of this cylindrical body 104, and 4 pieces of antenna elements 105 to 108 are short circuited at an upper portion of the cylindrical body 104. This feeding point corresponds to a joint point between the signal output units 113*b* to 114*c* and the signal input units 105*a* to 108*a*.

Also, in this first preferred embodiment, the feeding circuit 102 is arranged at such a position that the respective signal output units 113*b* to 114*b* are made coincident with the edge portion 104*a* on the axial center "α". Alternatively, the respective signal output units 113*b* to 114*b* may not be made coincident with the edge portion 104*a* on the axial center "α". In principle, the respective signal output units 113*b* to 114*b* may be arranged in such a way that these signal output units 113*b* to 114*b* are located close to one point on the axial center Further, in this first preferred embodiment, the cylindrical body 104 is made of tetrafluorethylene. Alternatively, this cylindrical body 104 may be made of other resin such as polypropylene, or film-shaped resin. Also, the copper wires are employed so as to manufacture the antenna elements 105 to 108. Alternatively, even when the antenna elements are directly printed, or directly plated on the cylindrical body 104 made of resin, a similar effect may be achieved. In addition, in such a case that the cylindrical body 104 is formed in a film shape, the antenna elements maybe easily printed, or plated on this film-shaped cylindrical body 104.

Figure 7:
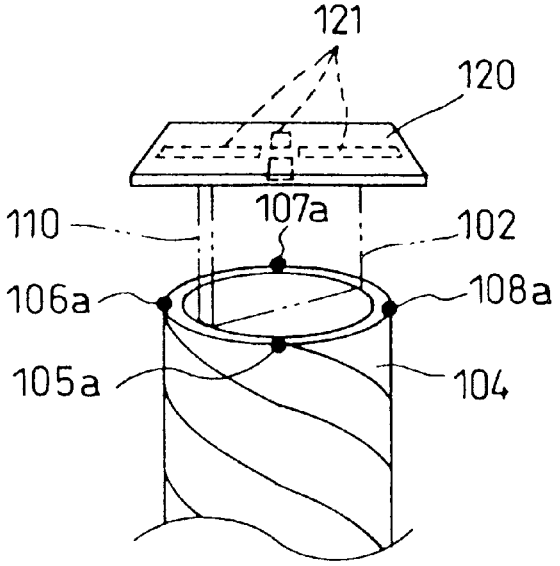
FIG. 7 is a fragmentary perspective view for indicating a major portion of an antenna element as another modification of FIG. 1 in an enlarged form.

In this first preferred embodiment, the hybrid circuit 112 is directly connected to both the balun circuits 113 and 114 via the 50 Ω-signal line 115, the 50 Ω-signal line 116, the throughhole electrode 117, and also the 50 Ω-signal line 118. Alternatively, as shown in FIG. 7, either an impedance matching circuit 20 or another impedance matching circuit 21 may be inserted into the signal line connected to the 50 Ω-signal line 115 and the 50 Ω-signal line 118. After the output signal of the hybrid circuit 112 is processed by these impedance matching circuits 20 and 21, the processed signal may be inputted into the balun circuit 113 and the balun circuit 114. In this alternative case, the impedance of the antenna may be matched, so that the reflection loss caused by the mismatching operation can be reduced, and the electromagnetic wave can be irradiated from this antenna in a high efficiency.

Also, in this first preferred embodiment, the inventive idea of the present invention is embodied in the helical antenna equipped with the four antenna elements 105 to 108. A total number of antenna elements is not limited to four elements, but may be similarly applied to other numbers. That is, apparently, the present invention may be embodied in a helical antenna equipped with a plurality of antenna elements other than 4 elements. More specifically, when the inventive idea of the present invention is embodied in such a helical antenna equipped with plural antenna elements, the quantity of which is equal to a multiple number of 2, a feeding means may be constituted by way of a circuit arrangement substantially similar to that of the above-described embodiment.

Also, in accordance with this first preferred embodiment, since the groove is digged in the cylindrical body 104 made of the resin so as to wind thereon the antenna elements 105 to 108, the antenna shape can be maintained under stable condition, and furthermore the electric characteristic of the helical antenna can be stabilized as well as can be manufactured in an easy manner.

Also, in this first preferred embodiment, the feeding line is constituted by the conductive wire. Alternatively, as shown in FIG. 7, a feeding line 121 may be constituted by a wiring pattern formed on an insulating board 120. In this alternative case, the length of this feeding line 121 may be continuously kept constant without any loose line portion, so that there is no error in the length of the wired feeding line 121.

Also, in order to connect/fix the board 120 to the cylindrical body 104, the feeding line 121 may be connected to the signal input units 105*a* to 108*a* by using either soldering agent or conductive adhesive agent under such a condition that the board 120 abuts against the edge portion 104*a* of the cylindrical body 104. In this alternative case, the feeding line 121 may be connected to the signal input units 105*a* to 108*a* in a simpler manner than that of the above-explained feeding line made of the conductive wire.

Moreover, in this alternative case, the board 120 may be supported/fixed to one edge portion 104*a* of the cylindrical body 104 by way of the adhesive forces produced by the soldering agent and the conductive adhesive agent.

Alternatively, if the feeding line 121 is formed on the board 120 in the form of a wiring pattern, then the board 110 for mounting thereon the feeding circuit 102 may be connected/fixed on the insulating board 120. In this alternative case, the board 110 may be mounted inside the cylindrical body 104 under such a condition that this board 110 is connected/fixed on the insulating board 120. As a result, the work required to support/fix the board 110maybe simplified.

Furthermore, this insulating board 120 may be made in an integral form with the cylindrical body 104.

Figure 8:
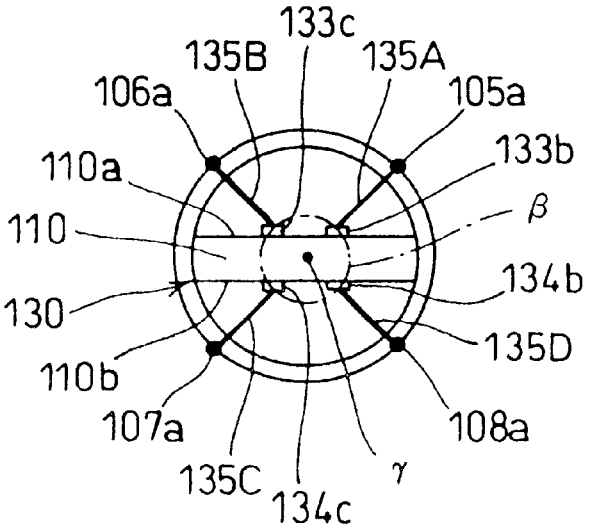
FIG. 8 is a plan view for representing a helical antenna according to a second preferred embodiment of the present invention.
Figure 9:
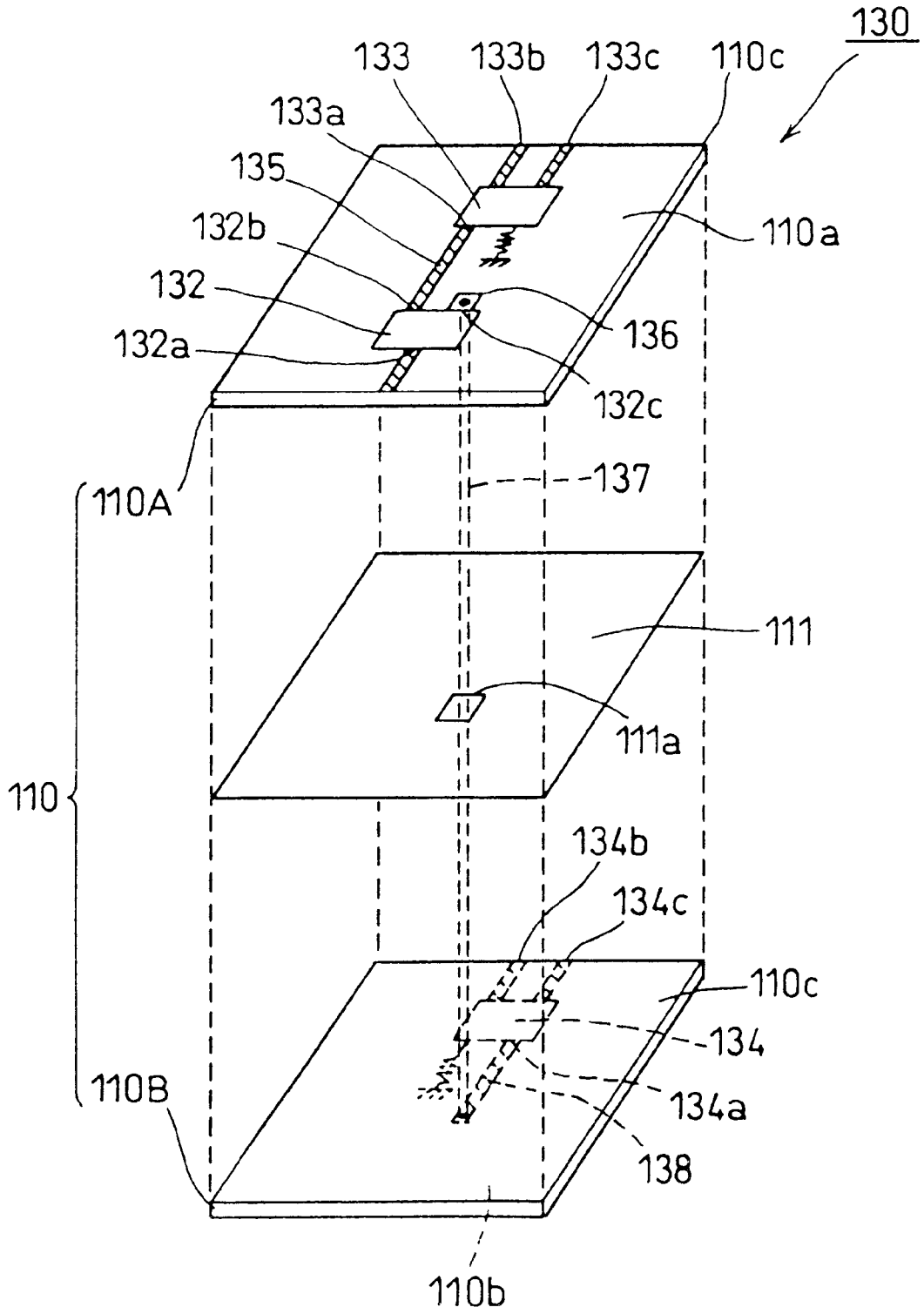
FIG. 9 is a fragmentary perspective view for representing a feeding circuit of the helical antenna shown in FIG. 8.

Next, a helical antenna according to a second preferred embodiment of the present invention will now be explained with reference to FIG. 8 and FIG. 9. As shown in the drawings, the signal input units 105*a* to 108*a* of the antenna elements 105 to 108 are arranged in an equi-interval on the edge portion 104*a* along the circumferential direction every angle of 90° (90 degrees).

A feeding circuit 130 is provided on the insulating board 110. Signal output units 133*b* to 134*c* of this feeding circuit 130 are arranged on the board edge portion 110*c* of the board 110.

The respective signal output units 133*b* to 134*c* are arranged on a circumference of a circle "β" on the board edge portion 110*c* with respect to a center "γ" of the edge portion along a longitudinal direction.

The signal output unit 133*b* for the 0° output, the signal output unit 133*c* for the 90° output, the signal output unit 134*b* for the 180° output, and the signal output unit 134*c* for the 270° output are sequentially arranged on the circle "β" in a substantially equi-interval along the circumferential direction in this order.

To arrange these signal output units 133*b* to 134*c* in this manner, the feeding circuit 130 is constituted as follows:

Both a 3-dB-hybrid circuit 133 and a balun circuit 132 are mounted on one surface 110*a* of the board 110. This one surface 110*a* is located on the outside of the dielectric board 110A.

A 3-dB-hybrid circuit 134 is mounted on the other surface 110*b* of the board 110, and the other surface 110*b* is located on the outside of the dielectric board 110B.

The balun circuits 133 and 134 are arranged with sandwiching the board 110 in such a manner that the balun circuit 133 is located opposite to the balun circuit 134 along the thickness direction thereof.

The balun circuit 132 produces both a 0° output and a 180° output, whereas the hybrid circuits 133 and 134 produce both a 0° output and a 90° output from the output derived from the balun circuit 132.

A power feeding connector 103 (not shown) is connected to an input unit 132*a* of the balun circuit 132.

The signal output unit 132*b* for 0° output of the balun circuit 132 is connected to an unbalance terminal 133*a* of the hybrid circuit 133 via a signal line 135 having a resistance value of 50 Ω formed on the plane 110*a* of the board 110.

The signal output unit 132*c* for 180° output of the balun circuit 132 is connected to the unbalance terminal 134*a* of the hybrid circuit 134 via another 50 Ω-signal line 136 formed on the plane 110*a* of the insulating board 110, a throughhole electrode 137 formed on the board 110 by penetrating this board 110, and another 50 Ω-signal line 138 formed on the plane 110*b* of the board 110.

A notch 111*a* is formed in the ground layer 111. This notch 111*a* allows the throughhole electrode 137 to penetrate this notch 111*a* under electrically insulating condition.

Both the signal output unit 133*b* for 0° output of the hybrid circuit 133 and the signal output unit 133*c* for 90° output thereof extended up to the board edge portion 110*c* which is located in the vicinity of the balun circuits 133 and 134, on one surface 110*a* of the board 110.

Both the signal output unit 134*b* for 90° output of the hybrid circuit 134 and the signal output unit 134*c* for 0° output thereof are extended up to the board edge portion 110*c* which is located in the vicinity of the balun circuits 133 and 134, on the other surface 110*b* of the board 110.

The respective signal output units 133*b* to 134*c* are extended up to the board edge portion 110*c* by way of the 50 Ω-signal line.

The signal output units 133*b* and 133*c* are arranged at symmetrical positions on one surface 110*a* of the board 110 while sandwiching the center along the board width direction, namely positions separated from a center of the board width by the same distances.

The signal output units 134*b* and 134*c* are arranged at symmetrical positions on the other surface 110*b* of the board 110 while sandwiching the center along the board width direction.

With employment of the above-described arrangement, both the signal output units 133*b*/133*c* and the signal output units 134*b*/134*c* are sequentially arranged in an equi-interval of 90° in this order of 0°-output, 90°-output, 180°-output, and 270°-output at such positions. That is, these positions are separated from each other by the phase angle of approximately 90 degrees on the circle "β" while setting as a center the center "γ" of the board edge portion 110*c* of the board 110 along the width direction.

It should be also noted that the phase delay amounts of these outputs may be shifted from each other by the angle of essentially 90 degrees. Moreover, these phase shift amounts may be approximated to 90 degrees as close as possible, but need not be correctly set to 90 degrees, as apparent from the foregoing description.

The feeding circuit 130 equipped with the above-described arrangement is inserted into an internal space of the cylindrical body 104 to be arranged therein, while satisfying the below-mentioned conditions:

(1) A condition under which the edge portion 110*c* of the board 110 is located on the side of the edge portion 104*a* of the cylindrical body 104. The respective signal output units 133*b* to 134*c* are provided on the edge portion 110*c*, and the respective signal input units 105*a* to 108*a* are provided on the edge portion 104*a*.

(2) A condition under which the edge portion 110*c* of the board 110 is positioned substantially coincident with the edge portion 104*a* of the cylindrical body 104.

(3) A condition under which the direction of the board 110 is set in such a manner that the arranging phase angles of the signal output units 133*b* to 134*c* on the board edge portion 110*a* are made coincident with those of the signal input units 105*a* to 108*a* on the edge portion 104*a*.

As a result, the circle "β" is arranged at a position on the edge portion 104*a*, and this position is located in a coaxial manner with respect to the cylindrical body 104. Both the signal output units 133*b* to 134*c* and the signal input units 105*a* to 108*a* are arranged in such a manner that the signal output units are separated from the signal input units in an equi-interval along the circumferential direction on the respective circumferences of two circles (namely, circle "β" and edge portion 104*a*) which are positioned in a coaxial manner.

Both the signal output units 133*b* to 134*c* and the signal input units 105*a* to 108*a* are arranged at the same phase angle positions, and are arranged at positions located along the radial direction of the circle "β" under such a condition that these signal output/input units are positioned in an one-to-one correspondence relationship.

After the feeding circuit 130 has been stored into the cylindrical body 104, both the signal output units 133*b* to 134*c* and the signal input units 105*a* to 108*a* are connected to each other by using a power feeding line 135 made of a conductive wire and the like. These signal output/input units are arranged on the same radius of the circle "β". In other words, the signal output unit 133*b* for 0° output is connected via a power feeding line 135A to the signal input unit 105*a*. The signal output unit 133*c* for 90° output is connected via a power feeding line 135B to the signal input unit 106*a*. This signal input unit 106*a* is arranged apart from the signal input unit 105*a* at an angle of 90 degrees along a left turning direction, as viewed in this drawing. The signal output unit 134*c* for 180°-delayed output is connected via a power feeding line 135C to the signal input unit 107*a*. This signal input unit 107*a* is arranged apart from the signal input unit 106*a* at an angle of 90 degrees along a left turning direction, as viewed in this drawing. The signal output unit 134*b* for 270° output is connected via a power feeding line 135D to the signal input unit 108*a*. This signal input unit 108*a* is arranged apart from the signal input unit 107*a* at an angle of 90 degrees along a left turning direction, as viewed in this drawing.

When the respective signal output units 133*b* to 134*c* are connected to the respective signal input units 105*a* to 108*a* in the above-described manner, the electric lengths of the respective feeding lines 135A to 135D are made substantially equal to each other. In other words, as previously explained, the respective signal input units 105*a* to 108*a* are formed on the edge portion 104*a* in an equi-interval along the circumferential direction. The signal output units 133*b* to 134*b* are provided in an equi-interval along the circumferential direction on the circumference of such a circle positioned in a coaxial manner with respect to the cylindrical body 104. In this concrete example, as one example, this circle corresponds to a circle "β" positioned in a coaxial manner with respect to the edge portion 104*a*. As a result, the separation distances between the signal input units 105*a* to 108*a* and the signal output units 133*b* to 133*c* will become constant in view of the geometrical aspect. These signal output units 133*b* to 134*c* are located at the nearest positions with respect to these signal input units. As a consequence, the length of the respective feeding lines 135A to 135D are made substantially identical to each other, and these feeding lines 135A to 135D are used to connect the signal input units 105*a* to 108*a* with the respective signal output units 133*b* to 134*c*, resulting in a similar effect to that of the first preferred embodiment.

Moreover, since the signal output units 133*b* to 134*c* are provided at the positions defined at the same phase angles with the signal input units 105*a* to 108*a* on the circumference of the circle "β", the separation distances between the signal input units 105*a* to 108*a* and the signal output units 133*b* to 134*b* will become the shortest lengths in view of the geometrical aspect. Accordingly, the lengths of the respective feeding lines 135A to 135D for connecting the signal input units 105*a* to 108*a* with the respective signal output units 133*b* to 134*c* can be made shorter, so that a better electric characteristic (resistance characteristic and so on) can be achieved.

Furthermore, since the arranging plane of the circle "β" is made coincident with the setting position of the edge portion 104*a*, the electric lengths of the respective feeding lines 135A to 135D are made minimum, so that a better electric characteristic (resistance characteristic and so on) of the helical antenna can be achieved.

In this second embodiment, the feeding circuit 130 is arranged in such a manner that the plane where the circle "β" is arranged is made coincident with the edge portion 104*a*. Alternatively, according to the present invention, the arranging plane of this circle "β" may not be made coincident with the edge portion 104*a*. Essentially speaking, the circle "β" may be arranged in parallel to the edge portion 104*a* with keeping a coaxial relationship.

In this case, the stacked layer board 110 constitutes the insulating board. The cylindrical body 104 constitutes a first holding mechanism. The stacked layer board 110 constitutes a second holding mechanism. Both the balun circuit 132 and the hybrid circuit 133 constitute a first phase adjusting circuit. The hybrid circuit 134 constitutes a second phase adjusting circuit. The edge portion 104*a* of the cylindrical body 104 constitutes the circumference on which the signal input units are arranged. The circle "β" constitutes another circumference.

The board edge portion 110*c* formed on one plane 110*a* of the board 110 will constitute a first arranging portion on which the signal output units 133*b* and 133*c* are arranged. The board edge portion 110*c* formed on the other plane 110*b* of the board 110 will constitute a second arranging portion on which the signal output units 134*b* and 134*c* are arranged. Then, an arranging portion is constituted by these first arranging portion and second arranging portion.

As the first holding mechanism, also in this second embodiment, the present invention is not limited to such a cylindrical body 104, the section of which is a circle, but other shaped cylinder bodies may be employed, the sections of which are selected from an elliptical shape, a polygonal shape, and so on. Also, the first holding mechanism may be realized by such a cylinder body having different diameters along an axial direction thereof, other than another cylindrical body having a uniformly equal diameter along the axial direction.

Figure 10:
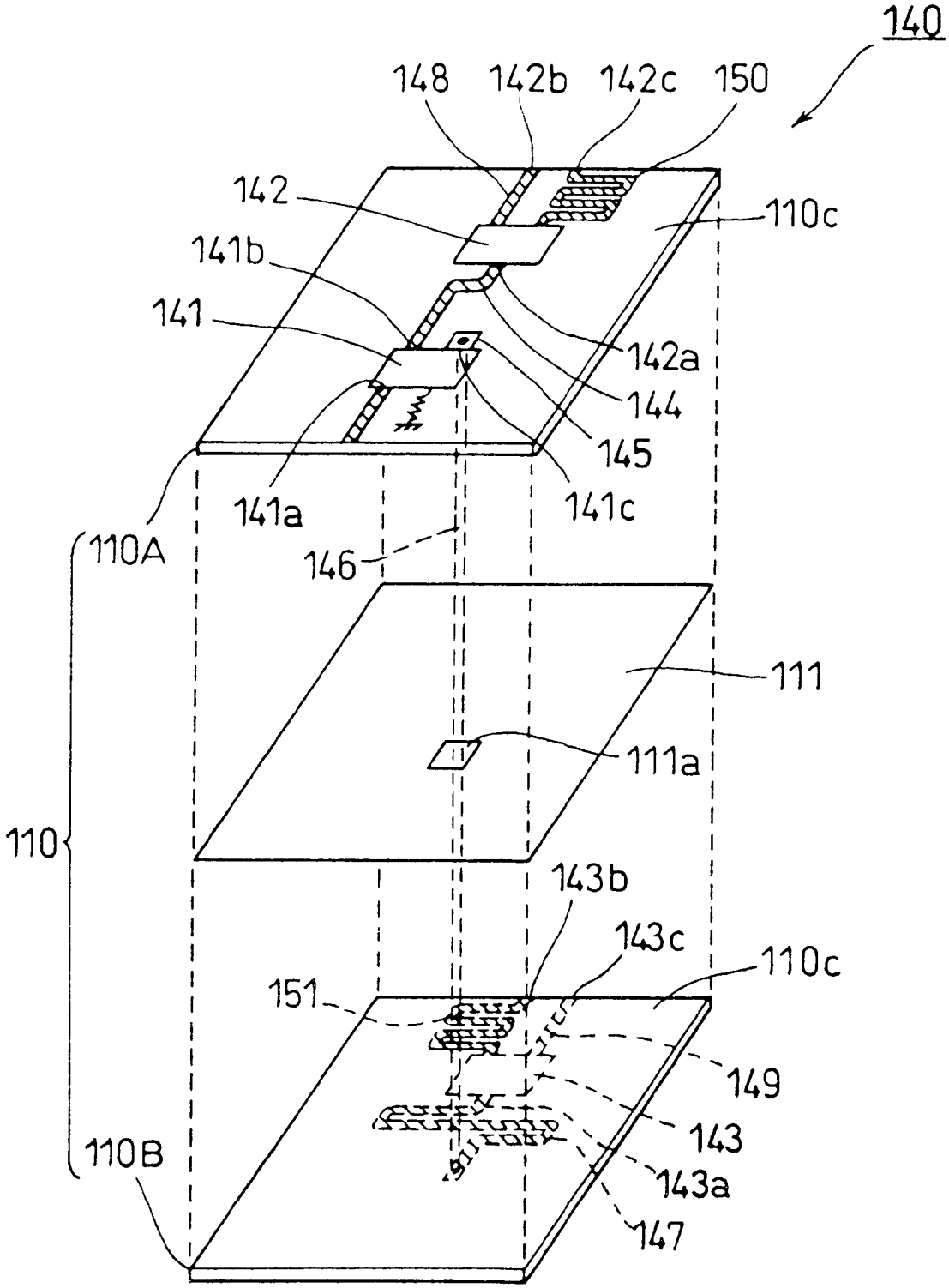
FIG. 10 is a fragmentary perspective view for showing a feeding circuit of an antenna element as a modification of FIG. 9.
Figure 11:
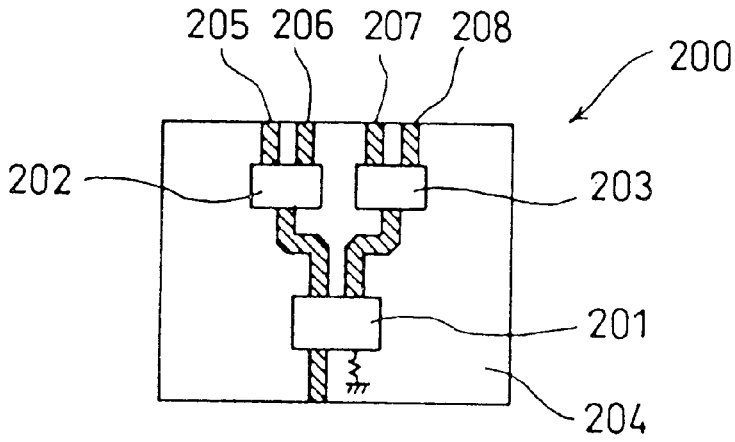
FIG. 11 is a plan view for showing the feeding circuit of the conventional helical antenna.
Figure 12:
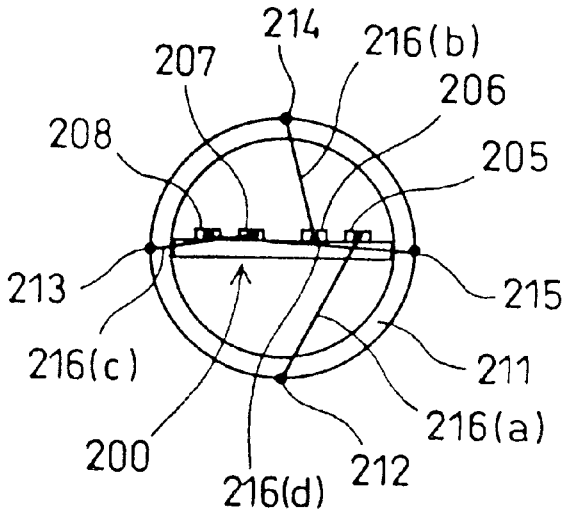
FIG. 12 is a plan view for indicating the conventional helical antenna of FIG. 11.

In this second embodiment, in order that the signal output unit 133*b* for the 0° output, the signal output unit 133*c* for the 90° output, the signal output unit 134*c* for the 180° output, and the signal output unit 134*b* for the 270° output are sequentially arranged on this circle "β" in this order, the feeding circuit 140 may be arranged as follows:

That is to say, as illustrated in FIG. 10, in the board 110, both the 3-dB-hybrid circuit 141 and the balun circuit 142 are mounted on one plane 110*a* which is located outside the dielectric board 110A. The balun circuit 143 is mounted on the other plane 110*b* which is located outside the dielectric board 110B. The balun circuit 142 is arranged opposite to the balun circuit 143 along the thickness direction by sandwiching the board 110.

The hybrid circuit 141 produces the 0°-output and the 90°-output, whereas both the balun circuits 142 and 143 produce the 0°-output and the 180°-output from the outputs of the hybrid circuit 141.

A power feeding connector (not shown) 103 is connected to the input unit 141*a* of the hybrid circuit 141.

The signal output unit 141*b* of the 0°-output from the hybrid circuit 141 is connected to an unbalance terminal 142*a* of the balun circuit 142 via the 50 Ω-signal line 144 provided on one plane 111*a* of the board 110.

The signal output circuit 141*c* for 90°-delayed output of the hybrid circuit 141 is connected to the unbalance terminal 143*a* of the balun circuit 143 via a 50 Ω-signal line 145 formed on the plane 110*a* of the stacked layer board 110, a throughhole electrode 146 formed on the board 110 by penetrating this board 110, and another 50 Ω-signal line 147 formed on the other plane 110*b* of the board 110.

The above-described 50 Ω-signal line 147 owns a signal line length of λy/4 (symbol "λy" being wavelength) so as to delay a signal by only 90 degrees.

A notch 111*a* is formed in the ground layer 111. This notch 111*a* allows the throughhole electrode 137 to penetrate this notch 111*a* under electrically insulating condition.

The signal output unit 142*b* and another signal output unit 142*c* of the balun circuit 142 are extended up to the board edge portion 110*c* on one plane 110*a* of the board 110. This board edge portion 1110*c* is located in the vicinity of the balun circuits 142 and 143.

The signal output unit 143*b* and another signal output unit 144*c* of the balun circuit 143 are extended up to the board edge portion 110*c* on the other plane 110*b* of the board 110. This board edge portion 110*c* is located in the vicinity of the balun circuits 143 and 144.

Both the signal output units 142*b* and 143*c* are extended up to the edge portion 110*c* of the board 110 by way of the 50 Ω-signal lines 148 and 149. Both the signal output units 142*c* and 143*b* are extended up to the board edge portion 110*c* by way of the 50 Ω-signal lines 150 and 151.

These 50 Ω-signal lines 150 and 151 own signal line lengths of λy/4 (symbol "λy" being wavelength) so as to delay a signal by 90 degrees.

With employment of the above-described arrangement, the signal output unit 142*b* constitutes the 0°-output signal output unit of the feeding circuit 140, the signal output unit 142*c* constitutes the 270°-output signal output unit thereof, the signal output unit 143*b* constitutes the 90°-output signal output unit thereof, and also the signal output unit 143*c* constitutes the 180°-output signal output unit thereof. As a result, the 0°-output signal output unit, the 90°-output signal unit, the 180°-output signal unit, and the 270°-output signal unit are sequentially arranged at the positions on the circle "β" separated by the phase angle of 90 degrees. This circle "β" is located as a center of the board edge portion 110*c* of the board 110 along the width "H" direction thereof.

In this case, a first phase adjusting circuit is arranged by the hybrid circuit 141, the balun circuit 142, and the 50 Ω-signal line 150. A second phase adjusting circuit is arranged by the 50 Ω-signal line 147, the balun circuit 143, and the 50 Ω-signal line 151. The board edge portion 110*c* formed on one plane 110*a* of the board 110 constitutes a first arranging unit where the signal output units 142*b* and 142*c* are arranged.

The board edge portion 110*c* formed on the other plane 110*b* of the board 110 constitutes a second arranging unit where the signal output units 143*b* and 143*c* are arranged. These first arranging unit and second arranging unit will constitute an arranging unit.

Although the invention has been described in detail in its most preferred embodiments, the combination and array of parts for its preferred embodiments can be modified in various manners without departing from the spirit and scope thereof, as claimed in the following.

What is claimed is:

1. A helical antenna comprising:

a plurality of antenna elements, each of which antenna elements having a signal input unit for an electric power feeding signal;

feeding means having at least plural signal output units corresponding to the number of said signal input units, for outputting the feeding signals from the respective signal output units while giving a predetermined phase difference to said feeding signals;

a first holding mechanism for holding the respective signal input units of said antenna elements on the substantially same circumference, said first holding mechanism is constructed of a tube body, an adjoining portion of which is located within a plane, said adjoining portion containing an edge plane of said tube body, and the respective signal input units of said antenna elements are held at said adjoining portion of said tube body;

a second holding mechanism for holding the respective signal output units of said feeding means on a line which is located perpendicular to said plane where said circumference is positioned, and also which passes through an essential center of said circumference; and a plurality of feeding lines for connecting the respective signal input units of the respective antenna elements to the respective signal output units of said feeding means with maintaining the individual relationship among them;

said feeding means includes a circuit board; and a feeding circuit mounted on said circuit board, and having the respective signal output units, for processing said feeding signals to output the processed feeding signals from the respective signal output units, while applying a predetermined phase difference to the processed feeding signals;

said circuit board contains an arranging unit where the respective signal output units are arranged;

said circuit board is held by said tube body in such a manner that said arranging unit is located within a plane which is positioned in parallel to such a plane involving a plane which passing through said edge plane of the tube body; and the stacked layer board is held by the tube body with a planar direction of the board being parallel to a direction of the axial center of the tube body.

2. The helical antenna as claimed in claim 1 wherein:

said tube is a cylindrical body.

3. The helical antenna as claimed in claim 1 wherein:

said plurality of antenna elements are four elements; and said feeding circuit adjusts the phases of the respective feeding signals so as to have phase differences by essentially 90 degrees, thereafter outputs the phase-adjusted feeding signals from the respective output terminals.

4. The helical antenna as claimed in claim 3 wherein:

said feeding circuit includes:

a first phase adjusting circuit provided on one plane of said circuit board, for delaying the phases of said feeding signals at phase angles of essentially 0°/90°/180°; and a second phase adjusting circuit provided on the other plane of said circuit board, for delaying the 90°-delayed phase of the feeding signal outputted from said first phase adjusting circuit at phase angles of essentially 0°/180°;

said arranging unit contains:

a first arranging unit provided on said one plane of said circuit board in correspondence with said first phase adjusting circuit; and a second arranging unit provided on said other plane of said circuit board in correspondence with said second phase adjusting circuit.

5. The helical antenna as claimed in claim 1 wherein:

said feeding means is further comprised of an impedance matching circuit.

6. The helical antenna as claimed in claim 1 wherein:

said feeding line is constructed of an electric wire.

7. The helical antenna as claimed in claim 1 wherein:

said feeding line is constructed of a wiring pattern formed on a board.

8. The helical antenna as claimed in claim 1 wherein:

the stacked layer board is disposed in the interior of the tube body.

9. The helical antenna as claimed in claim 1, wherein:

the stacked layer board is held within the cylindrical body in such a manner that an edge portion of this stacked layer board is located within a plane which passes through the edge of the cylindrical body.

10. A helical antenna comprising:

a plurality of antenna elements, each of which antenna elements having a signal input unit for an electric power feeding signal;

feeding means having at least plural signal output units corresponding to the number of said signal input units, for outputting the feeding signals from the respective signal output units while giving a predetermined phase difference to said feeding signals;

a first holding mechanism for holding the respective signal input units of said antenna elements on the substantially same circumference in an equi-interval along a circumferential direction thereof, said first holding mechanism is constructed of a tube body, an adjoining portion of which is located within a plane, said adjoining portion containing an edge plane of said tube body, and the respective signal input units of said antenna elements are held at said adjoining portion of said tube body;

a second holding mechanism for holding the respective signal output units of said feeding means on an another circumference in an equi-interval along a circumferential direction thereof, said another circumference being provided in a plane which is parallel to the plane of said circumference, or on the same plane as said circumference, while setting as a center one point on a line which is located perpendicular to a plane where said circumference is positioned, and also which passes through an essential center of said circumference; and a plurality of feeding lines for connecting the respective signal input units of the respective antenna elements to the respective signal output units of said feeding means with maintaining the individual relationship among them;

said feeding means include a circuit board; and a feeding circuit mounted on said circuit board, and having the respective signal output units, for processing said feeding signals to output the processed feeding signals from the respective signal output signal, while applying a predetermined phase difference to the processed feeding signals;

said circuit board contains an arranging unit where the respective signal output units are arranged;

said circuit board is held by said tube body in such a manner that said arranging unit is located within a plane which is positioned in parallel to such a plane involving a plane which passes through said edge plane of the tube body; and the stacked layer board is held by the tube body with a planar direction of the board being parallel to a direction of the axial center of the tube body.

11. A helical antenna as claimed in claim 10 wherein:

said second holding mechanism holds said signal output units at the same phase angle positions as said signal input units.

12. The helical antenna as claimed in claim 10 wherein:

said tube is a cylindrical body.

13. The helical antenna as claimed in claim 10 wherein:

said plurality of antenna elements are four elements; and said feeding circuit adjusts the phases of the respective feeding signals so as to have phase differences by essentially 90 degrees, thereafter outputs the phase-adjusted feeding signals from the respective output terminals.

14. The helical antenna as claimed in claim 13 wherein:

said feeding circuit includes:

a first phase adjusting circuit provided on one plane of said circuit board, for delaying the phases of said feeding signals at phase angles of essentially 0°/90°/180°; and a second phase adjusting circuit provided on the other plane of said circuit board, for delaying the 180°-delayed phase of the feeding signal outputted from said first phase adjusting circuit at phase angles of essentially 0°/90°;

said arranging unit contains:

a first arranging unit provided on said one plane of said circuit board in correspondence with said first phase adjusting circuit; and a second arranging unit provided on said other plane of said circuit board in correspondence with said second phase adjusting circuit.

15. The helical antenna as claimed in claim 10 wherein:

the stacked layer board is disposed in the interior of the tube body.

16. The helical antenna as claimed in claim 10, wherein:

the stacked layer board is held within the cylindrical body in such a manner that an edge portion of this stacked layer board is located within a plane which passes through the edge of the cylindrical body.

* * * * *